United States Patent [19]

Held

[11] Patent Number: 4,665,818

[45] Date of Patent: May 19, 1987

[54] SLIDING SURFACE SEALS FOR A DOUBLE BAND PRESS

[76] Inventor: Kurt Held, Alte Strasse 1, 7218 Trossingen 2, Fed. Rep. of Germany

[21] Appl. No.: 783,416

[22] Filed: Oct. 3, 1985

[30] Foreign Application Priority Data

Oct. 3, 1984 [DE] Fed. Rep. of Germany ..... 3436158

[51] Int. Cl.[4] ..... B30B 5/06

[52] U.S. Cl. ..... 100/154; 100/93 RP; 156/555; 156/583.5

[58] Field of Search ..... 100/93 RP, 151, 153, 100/154; 156/555, 583.5; 425/371; 277/3, 27; 308/3.5

[56] References Cited

U.S. PATENT DOCUMENTS

| | | | |
|---|---|---|---|
| 4,193,342 | 3/1980 | Held | 100/154 |
| 4,253,391 | 3/1981 | Held | 100/154 |
| 4,285,525 | 8/1981 | Held | 100/154 X |
| 4,331,073 | 5/1982 | Girola | 100/154 |
| 4,541,889 | 9/1985 | Held | 100/154 X |

FOREIGN PATENT DOCUMENTS

| | | |
|---|---|---|
| 2937972 | 4/1981 | Fed. Rep. of Germany . |
| 3310700 | 9/1984 | Fed. Rep. of Germany . |

*Primary Examiner*—Billy J. Wilhite
*Attorney, Agent, or Firm*—Toren, McGeady and Goldberg

[57] ABSTRACT

In a double band press each of the press belts has an associated pressure chamber in which fluid pressure medium acts to pressurize the sheet form material passed between the press belts. Each pressure chamber is formed by a pressure plate, the associted press belt and a sliding surface seal mounted in a groove in the pressure plate with the seal in sliding contact with the press belt. The sliding surface seal is secured within a retaining member fitted with narrow play into a groove in the pressure plate. Each press belt extends horizontally between a pair of spaced rollers. The retaining member is vertically displaceable within the groove. Support members located within the pressure chamber secure the retaining member to the pressure plate. A groove seal in the form of an O-ring is located between the base of the groove and the retaining member and is in contact with the opposite sides of the groove. connecting passageways extend between the pressure chamber and the base of the groove so that the fluid pressure medium within the pressure chamber has access to the base of the groove.

11 Claims, 5 Drawing Figures

SLIDING SURFACE SEALS FOR A DOUBLE BAND PRESS

BACKGROUND OF THE INVENTION

The present invention is directed to a double band press for applying pressure over a planar area to a continuously moving sheet form material passing betweeen a pair of press belts. The press includes a rigid frame with rollers spaced apart and rotatably supported in bearing supports forming a part of the press frame. The press belts include an upper and lower endless press belt each guided over a pair of rollers. Each press belt in combination with an associated pressure plate, located between the rollers, and a sliding surface seal located in a retaining member define a pressure chamber. The retaining member is positioned within a groove formed in the surface of the pressure plate facing the associated press belt and the retaining member is vertically displaceable relative to the press belt. A fluid pressure medium can be introduced into the pressure chamber for applying pressure to the associated press belt and, in turn, to the sheet form material passing between the press belts. The retaining member is secured by support members located within the pressure chamber.

Double band presses are used to press continuously moving sheet form materials, such as particle boards, impregnated paper, decorative laminates, impregnated glass fiber and natural fiber, woven webs, plastics material or rubber sheets. In the so-called isobaric machines of this type, a liquid or gaseous pressure medium is introduced into a pressure chamber defined between a pressure plate and the associated press belt and defined laterally by a sliding surface seal in contact with the moving press belts. As a result, the sheet form material passing between the two belts is compressed by the action of the pressure medium within the pressure chambers.

The arrangement of such sliding surface seals is disclosed in U.S. Pats. Nos. 4,193,342, 4,253,391, 4,331,073 and 4,285,525. The purpose of these various seal arrangements is to introduce the force resulting from the sliding friction between the seal and the surface of the press belt, chiefly from the surfaces of the seal extending parallel to the direction of movement of the press belt, into the pressure plate and then into the press frame whereby the seal, with the least possible cross-section and, accordingly, the highest possible flexibility, is capable of receiving the friction forces.

It is taught, particularly in U.S. Pat. No. 4,331,073, to avoid the risk of tilting the retaining member in the groove bounding the pressure chamber, which retaining member acts as a holder or mount for the seal, by a particular arrangement of the elastic seal and by dimensioning the groove and the retaining member in accordance with the desired object.

A disadvantage of the sliding surface seal disclosed in U.S. Pat. No. 4,331,073 is that the retaining member illustrated in FIGS. 2 and 3 can bear against the outer side of the groove when the inner pressure side is under the pressure of the pressure medium in the pressure chamber, wherein the groove seal arranged against the retaining member and in contact with the surface of the groove on the side open to the ambient atmosphere is crushed in the gap between the retaining member and the groove surface on the ambient atmosphere side.

When such a condition exists, the contact joint between the retaining member and the support member opens so that the function of the support member, that is, to prevent tilting of the retainting member, is no longer present. As a result, not only is there undesirable tilting of the sliding surface seal and the retaining member mounting it in the groove, but also an even more dangerous addition of the friction forces between the moving press belt and the sliding surface seal.

Since such sliding surface seals have a considerable expansion in the direction of movement of the press belts, the addition of the friction forces between the press belt and the sliding surface seal results in forces which tend to break the retaining member and result in a leakage of the pressure medium from the pressure chamber at the location where the break or rupture in the retaining member takes place. As a result, the entire pressure system becomes ineffective.

SUMMARY OF THE INVENTION

Therefore, it is the primary object of the present invention to provide a sliding surface seal so that tilting of the retaining member in the groove is prevented whereby the friction forces developed are safely conducted into the pressure plate and any breakdown of the pressure system is effectively prevented. The construction of the seal and its holder or mount must afford movability in the vertical direction relative to the press belt so that the seal can adapt to different sheet form material thicknesses.

In accordance with the present invention, the retaining member for the seal is held in the groove with limited play between the sides of the groove. The retaining member and the support members are securely and rigidly connected to one another. The support members are secured to the pressure plate at a position spaced from the retaining member. A groove seal is located between the base of the groove in the pressure plate and the surface of the retaining member facing the base of the groove with the groove seal being formed as an O-ring member. The O-ring member has a cross-sectional size so that it contacts the opposite sides of the groove with one side of the groove being open to the pressure chamber and the other side of the groove being open to the ambient atmosphere about the double band press. Further, a connecting passageway is provided between the pressure chamber and the base of the groove inwardly from the surface of the pressure plate so that the pressure in the chamber acts in the base of the groove on the O-ring member. In the arrangement of the sliding surface seal according to the present invention, a gap does not develop between the retaining member and the surface of the groove on the ambient atmosphere side with the result that there is no extrusion of the elastic rubber material of the groove seal into the gap. Accordingly, crushing and breaking the seal material and tilting of the retaining member is impossible. Moreover, destruction of the sliding surface seal is avoided, since the friction forces developed between the press belt and the seal are safely conducted into the pressure plate. Therefore, breakdown of the pressure system is effectively prevented using the sliding seal surface according to the present invention.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
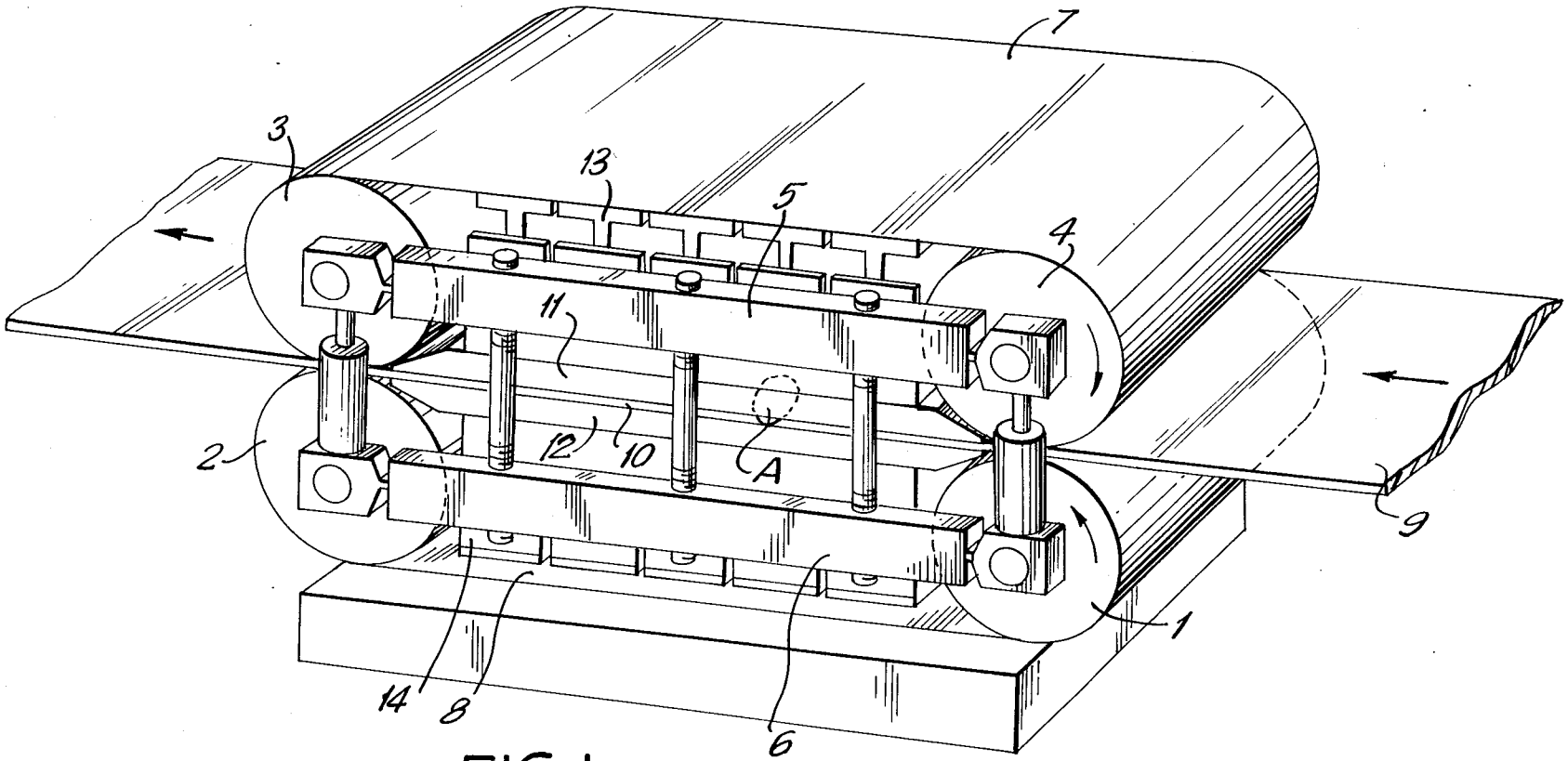
FIG. 1 is a schematic perspective side view of a double band press embodying the present invention.

A double band press for the continuous production of laminates is shown schematically in FIG. 1 and includes two pair of horizontally arranged rollers 1, 2, and 3, 4 rotatably supported in bearing members 5, 6 forming a part of the press frame. An upper press belt 7 extends around the upper pair of rollers 3, 4 while a lower press belt 8 extends around the lower pair of rollers 1, 2. The press belts are commonly formed of a high-tensile steel belt guided over a pair of the rollers. The press belts 7, 8 are tensioned with known means, for example, hydraulic cylinders, the tensioning means are not shown. Arrows shown on the ends of the rollers 1 and 4 indicate the direction of rotation of the rollers. A sheet form material 9 running in the direction of the arrows shown on the material, runs in the direction from the right to the left in FIG. 1. The sheet form material can be laminate material impregnated with synthetic resin, fiber/-binding agent mixtures or the like, compressed between the upper and lower press belts in a reaction zone 10 with the pressing action being accompanied by the simultaneous application of heat and pressure. Should the material being pressed require it, the pressing action can be effected without heat or by a cooling action.

The pressure exerted on the sheet form material 9 is applied on the inside of the lower run of the upper press belt 7 and on the inside of the upper run of the lower press belt 8. The pressure is exerted in the region between the rollers by means of an upper pressure plate 11 and a lower pressure plate 12 with the pressing action being transferred through the lower run of the upper press belt 7 and the upper run of the lower press belt 8 into the sheet form material 9. The reaction forces exerted by the material being pressed are transferred into the press frame indicated schematically by the pressure plates 11, 12 and the support members 13, 14 connected to the plates.

The rollers 1, 4 at the intake side of the double band press are heated and, in turn, heat the press belts 7, 8 running between the rollers. The heat transferred into the press belts is carried into the reaction zone by the press belts and is transmitted to the sheet form material 9 and serves to harden the material being pressed. The material being pressed can be heated by other means, for example, by heating the pressure plates themselves.

To generate the pressure acting on the surface of the sheet form material 9, a pressurized fluid medium can be introduced into the spaces between the pressure plate 11 and the press belt 7 and the pressure plate 12 and the press belt 8 in the region extending between the rollers 1, 2 and 3, 4. Each space or pressure chamber is defined laterally by a seal. A synthetic oil capable of withstanding the operating conditions in the double band press can be used as the pressure medium. It is also possible, however, to use a gaseous pressure medium, such as compressed air.

Figure 2:
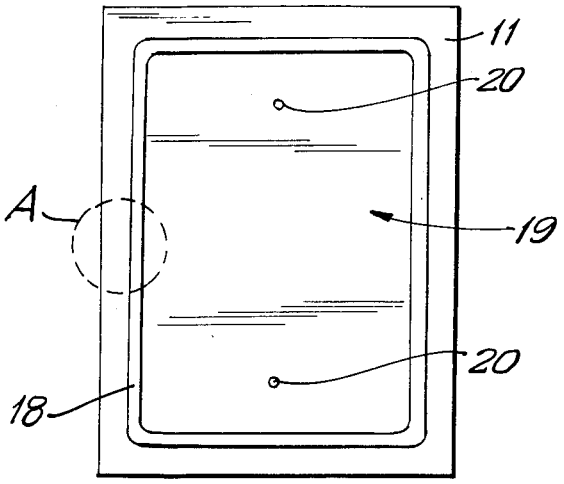
FIG. 2 is a view of a pressure chamber taken from the press belt side of the chamber.

In FIG. 2 a pressure chamber is shown as viewed from the associated press belt side. Pressure plate 11 is formed of a rectangularly shaped steel plate. A groove is formed in the surface of the plate facing toward the associated press belt. As can be seen in FIG. 2, the groove is spaced adjacent to the edge of the rectangular pressure plate. A seal 18 is located within the groove and encircles the space formed within the annular groove. A pair of inlets 20 are provided in the pressure plate inwardly of the seal for introducing the pressure medium into the pressure chamber 19 defined between the pressure plate 11 and the associated press belt 7 and bounded laterally by the seal 18. For heating purposes, the pressure plate 11 can be provided with transverse or longitudinally extending boreholes through which a heated thermal oil can be circulated.

Figure 3:
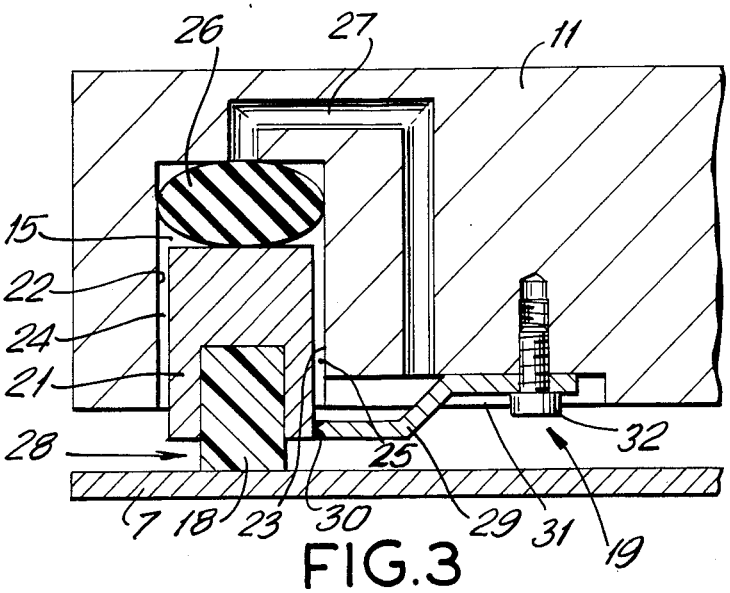
FIG. 3 is a sectional view through a portion of the pressure plate in the edge region including the sliding surface seal.

In FIG. 3 an enlarged detail section A of FIG. 1 is shown, that is, the region of the pressure chamber 19 adjacent the edge of the pressure plate 11. A groove 15 is formed inwardly in the surface of the pressure plate 11 facing the press belt 7 and the seal 18 is located within the groove. The seal 18 is substantially rectangular in cross-section and is formed of an elastomeric material. The seal is fixed in a recess formed in a U-shaped retaining member 21 so that the seal is held against longitudinal displacement. The width of the retaining member 21 is only slightly less than the inside dimension or width of the groove 15, that is, the spacing between the vertically extending side walls 22, 23 of the groove. As a result, a narrow space 24 and 25 is formed between the opposite vertically extending sides of the retaining member and the adjacent surfaces of the vertically extending sides of the groove 15. The spaces 24, 25 are preferably less than 1/10 mm wide.

In the base of the groove 15, between the surface of the retaining member 21 and the base of the groove, a groove seal 26, formed of elastic material, is arranged in the form of an O-ring. The O-ring 26 is in contact with the opposite side walls 22, 23 of the groove. A passageway 27 interconnects the pressure chamber 19 and the base of the groove 15 so that the O-ring 26 is pressurized. As a result, the O-ring 26 seals the passageway 27 with respect to the ambient atmosphere side 28 of the pressure chamber 19. The O-ring 26 bears on the retaining member 21 which is freely movable in the vertical direction, since it has a very narrow play or is close-fitting relative to the side walls 22, 23 of the groove 15. The seal 18 fitted in the retaining member 21 is thereby pressed against the outer surface of the lower run of the press belt 7. If the press belt deviates from the plane of movement because of different reaction forces, developed, for example, due to various thicknesses of the sheet form material 9, then the retaining member 21 along with the seal 18 follows the displacing movement of the press belt 7 without any tilting action within the groove 15 and the seal 18 always bears against the press belt 7 so that the pressure chamber 19 is securely sealed relative to the ambient atmosphere side 28.

Because of the close fit of the retaining member 21 relative to the side walls 22, 23 of the groove 15, there is practically no gap between the side wall 22 on the ambient atmosphere side and the retaining member 21 into which the groove seal 26 formed of a rubber elastic sealing material could penetrate due to an extrusion effect. If the retaining member 21 bears against the outer side wall 22 on the ambient atmosphere side of the groove due to the pressure existing within the pressure chamber 19, there is no crushing or breaking up of the material forming the groove seal 26. Accordingly, the groove seal 26 is effectively protected against destruction and no loss of the sealing function can occur during the operation of the double band press.

The inner end of the retaining member 21 within the pressure chamber 19 adjacent the press belt 7 is laterally supported by a number of spaced support members 29 which project between the retaining member and a position on the pressure plate spaced from the retaining member. The support members 29 are rigidly fixed to the retaining member 21 by a weld seam 30 in the embodiment shown in FIG. 3 and the weld seam can be formed by a YAG (yttrium-aluminum-garnet) laser welding device. This fixed connection can also be formed by hard soldering, cementing or bolting. Each support member 29 is secured within a recess 31 in the pressure plate 11 by means of bolts 32, at locations spaced inwardly from the groove 15. The seal 18 is fixed in the groove 15 in the direction of movement of the press belt 7 and contacts the upper surface of the lower run of the press belt located between the rollers 3, 4 which move with the forward feed speed of the shaft form material 9 under the seal 18. Due to the relative movement of the seal 18 and the press belt 7 the seal is characterized as a sliding surface seal. Due to this relative movement between the belt extending between the rollers and the seal, a friction force is developed which is proportional to the contact pressure and the sliding friction coefficients. This friction force which develops a pushing or pulling force on the seal 18 must be completely conducted into the pressure plate 11 without the seal being deformed in a manner where it would not completely fulfill its sealing function.

Because of the fixed and rigid connection due to the weld seam 30, the transverse and longitudinal forces as well as pushing and pulling forces transmitted by the seal 18 to the retaining member 21 are conducted into the support members 29 and then into the pressure plate 11 through the bolts 32. Accordingly, these forces, as mentioned above, are transferred into the press frame and do not impair the sealing action of the seal 18. Since the support members 29 also receive transverse forces, any tilting of the retaining member 21 in the groove 15 is prevented.

Figure 4:
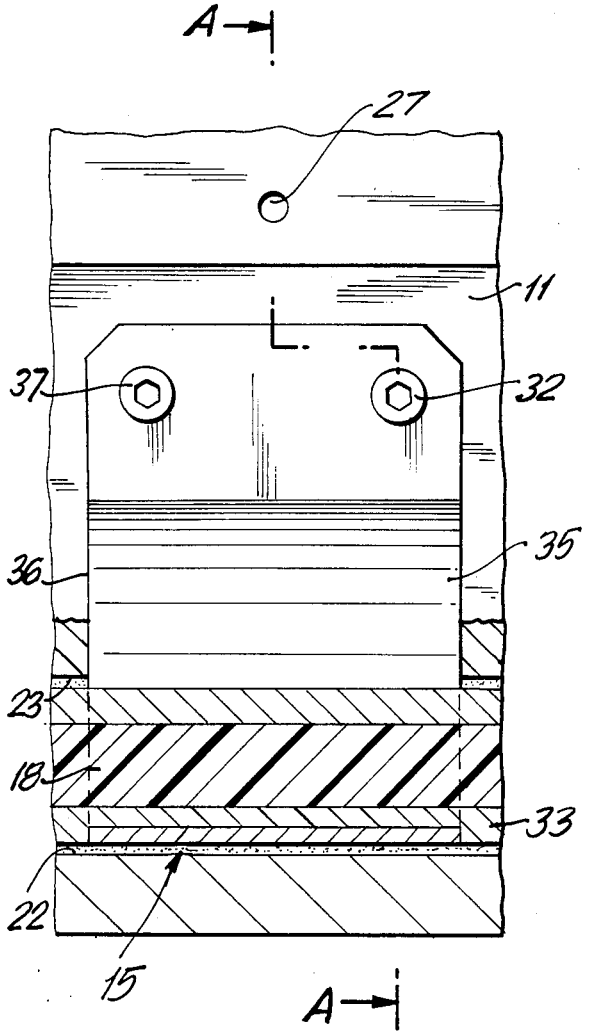
FIG. 4 is a top view, partly in section, of another embodiment of the sliding surface seal according to the present invention viewed from the press belt side of the seal.
Figure 5:
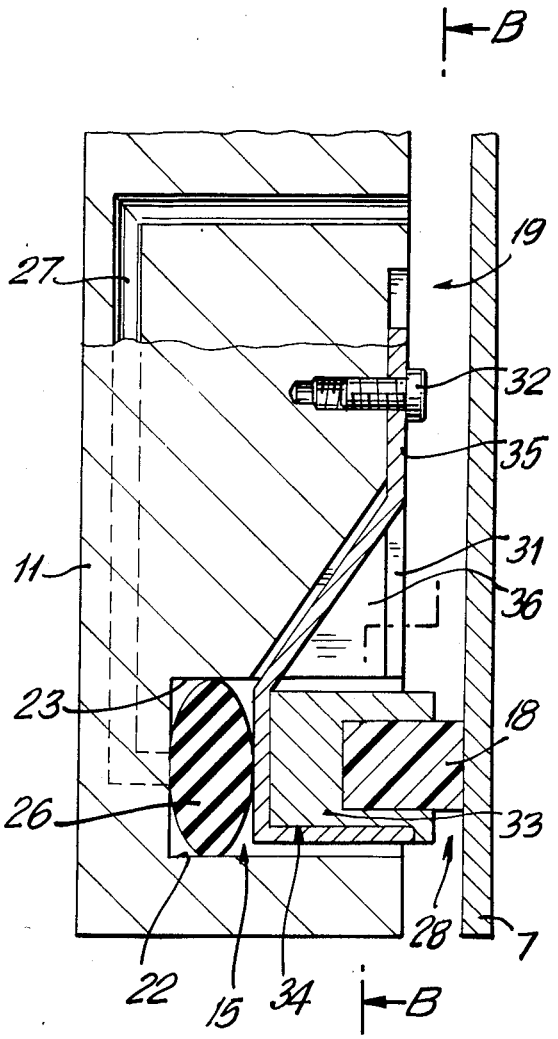
FIG. 5 is a sectional view taken along the line A—A in FIG. 4.

Another embodiment of a sliding surface seal, in accordance with the present invention, is shown in a sectional view in FIG. 4 as viewed from the press belt side and in FIG. 5 in a sectional view taken along the line A—A. The seal 18 is an elastomeric material and is securely inserted in a U-shaped retaining member 33 corresponding to the seal arrangement described above. This retaining member 33 fits within a groove 15 formed in the surface of the pressure plate 11 facing the press belt 7 so that the retaining member is vertically displaceable with only slight play. On the upper side of the retaining member 33 as viewed in FIG. 5, a groove seal 26 is provided as an O-ring and it is in contact with the opposite side walls 22, 23 of the groove 15, with the side wall 22 being located on the ambient atmosphere side of the pressure chamber and the side wall 23 being located on the pressure chamber side. Further, a passageway 27 is formed in the pressure plate 11 with one end open to the pressure chamber 19 and the other end open to the base of the groove 15. Grooves 34 are formed in the retaining member 33 in spaced relationship. Support members 35 are seated within the grooves 34 and extend from the groove 15 into the pressure chamber 19. Within the groove 15 the O-ring groove seal 26 bears against the support members 35. The support members 35 have an L-shaped configuration at the end where they are secured in the groove so that there is a fixed and rigid connection with the retaining member 33. As the support member 35 extends inwardly from the retaining member 33 it extends angularly through a recess 36 in the pressure plate 11 until it contacts the surface within the recess 31 which extends continuously in the long direction. Within the recess 31 the support member 35 is bent so that it extends in parallel relation with the surface of the pressure plate 11. At the end of the support member 35 within the recess 31 it is bolted to the pressure plate by means of a bolt 32. For better strength the support member 35 is formed as a monolithic member.

Since the support member 35 is securely and rigidly pressed against the retaining member 33, it can absorb the pushing and pulling force in the retaining member 33 which are developed due to the friction forces in the seal 18 and these forces can be transmitted into the pressure plate 11. To avoid any tilting of the retaining member 33 due to turning about the bolts 32, the support member 35 is also fastened to the pressure plate 11 by a second bolt 37, note FIG. 4. Another feature as illustrated in FIG. 4 is to form the recess 36 in the pressure plate 11 of such a size that there is only slight lateral play of the support member 35 or the member is fitted in an exact manner. In the first embodiment described above, a second bolt could be used to secure the support member 29 to prevent any twisting action.

While specific embodiments of the invention have been shown and described in detail to illustrate the application of the inventive principles, it will be understood that the invention may be embodied otherwise without departing from such principles.

I claim:

1. Double band press for applying pressure over planar surfaces to the oppositely facing surfaces of a sheet form material moving continuously in a first direction through the double band press comprising a rigid press frame including bearing members extending in the first direction, a pair of first horizontally arranged rollers rotatably supported in said bearing members and spaced apart in the first direction, a pair of second horizontally arranged rollers rotatably supported in said bearing members below said first rollers and spaced apart in the first direction, an upper endless press belt extending around said first rollers, a lower endless press belt extending around said second roller located below said upper press belt, said upper press belt having a lower run and said lower press belt having an upper run with the sheet form material arranged to pass between the lower run and the upper run, a first pressure plate disposed within said upper press belt between said first rollers and adjacent to the upper surface of the lower run of said upper press belt, a second pressure plate disposed within said lower press belt between said second rollers and adjacent to the lower surface of the upper run of said lower press belt, each of said first and second pressure plates having a surface facing the adjacent runs of said upper and lower press belts between which the sheet form material passes and an edge extending around the boundary of the surface, a continuous groove having opposite sides formed in each said surface adjacent the edge thereof, a retaining member positioned within and extending around said groove, said retaining member being displaceable within said groove perpendicularly relative to the adjacent said press belt, a sliding surface seal fitted within said retaining member and projecting therefrom into contact with the adjacent said press belt, the combination of each said first and second pressure plate and said retaining member and sliding seal associated therewith and the adjacent said press belt form a pressure chamber one above the lower run of said upper press belt and the other below the upper run of the lower press belt, support members for each said retaining member located within the associated said pressure chamber, and means for introducing a pressurizing fluid into said pressure chamber for directing pressure against said press belt positioned opposite to the associated said pressure plate, wherein the improvement comprises:

(1) said retaining member is arranged within said groove for affording limited play between said retaining member and the opposite sides of said groove extending transversely of the surface of said pressure plate containing the groove, (2) said retaining member and support members being securely and rigidly connected to one another, (3) said support members being secured to the associated said pressure plate at a position spaced from said retaining member, (4) a groove seal located within said groove between a base of said groove in said pressure plate and a surface of said retaining member facing the base of said groove, said groove seal comprising a continuous O-ring member, (5) said O-ring member having a transverse cross section so that the O-ring member contacts the opposite sides of said groove with one of said sides being open to the pressure chamber and the other of said sides open to the ambient pressure exteriorly of said pressure chamber, and (6) a connecting passageway extending between said pressure chamber and the base of said groove inwardly from said surface of said pressure plate so that the pressure in said pressure chamber acts in the base of said groove on said O-ring member.

2. Double band press, as set forth in claim 1, wherein each said support member is connected to the associated said retaining member by a welded joint.

3. Double band press, as set forth in claim 1, wherein said support member is securely cemented to the associated said retaining member by an adhesive joint.

4. Double band press, as set forth in claim 1, wherein each said support member is hard soldered to the associated said retaining member.

5. Double band press, as set forth in claim 1, wherein each said support member is securely bolted to the associated said retaining member.

6. Double band press, as set forth in claim 1, wherein said support member has an L-shaped section in contact with said retaining member and said support member is securely fitted within the L-shaped groove formed in the surface of said retaining member.

7. Double band press, as set forth in claim 6, wherein said support member is fitted in a recess formed in the surface of the associated said pressure plate so that it is held securely in place.

8. Double band press, as set forth in claim 7, wherein an end of said support member spaced from the associated said retaining member is fixed within a recess in the surface of the associated said pressure plate.

9. Double band press, as set forth in claim 1, wherein said support member is bolted to the associated said pressure plate at a position spaced from the associated said retaining member.

10. Double band press, as set forth in claim 9, wherein at least two said bolts secure said support member to the associated said pressure plate.

11. Double band press, as set forth in claim 1, wherein the spacing between the sides of said retaining member and extending perpendicularly to said press belt adjacent sides of said groove extending perpendicularly to said press belt is less than 1/10 mm.

* * * * *